US007520105B2

(12) United States Patent
Geller

(10) Patent No.: US 7,520,105 B2
(45) **Date of Patent: *Apr. 21, 2009**

(54) DRAWER OR DOOR FRONT ASSEMBLY WITH RECONFIGURABLE INSERTS PANEL

(76) Inventor: Gary Robert Geller, 15 SE. 15 Ave., Fort Lauderdale, FL (US) 33301

( * ) Notice: Subject to any disclaimer, the term of this patent is extended or adjusted under 35 U.S.C. 154(b) by 614 days.

This patent is subject to a terminal disclaimer.

(21) Appl. No.: 11/189,573

(22) Filed: Jul. 26, 2005

(65) Prior Publication Data

US 2007/0022691 A1 Feb. 1, 2007

(51) Int. Cl.
*E04C 2/52* (2006.01)

(52) U.S. Cl. ..... 52/784.1; 52/784.12; 220/315

(58) Field of Classification Search ..... 52/204.5, 52/455, 782.1, 171.1, 783.1, 784.1, 784.13; 312/348.4

See application file for complete search history.

(56) References Cited

U.S. PATENT DOCUMENTS 997,677 A 7/1911 Ivey
1,848,715 A 3/1932 Hart et al.
2,912,725 A 11/1959 Ries
3,333,385 A 8/1967 King
3,524,691 A 8/1970 Moore
4,327,535 A * 5/1982 Governale ..... 52/309.11
4,387,545 A * 6/1983 Kern ..... 52/455
4,589,240 A 5/1986 Kendall et al.
5,161,870 A 11/1992 Mason et al.
5,384,103 A 1/1995 Miller
5,533,312 A 7/1996 Mihalcheon
5,644,870 A * 7/1997 Chen ..... 49/501
5,951,133 A 9/1999 Dittberner et al.
6,088,993 A 7/2000 Irace
6,099,095 A 8/2000 Irace
6,132,540 A 10/2000 Barber et al.
6,161,363 A * 12/2000 Herbst ..... 52/784.15
6,357,610 B1 3/2002 Irace
6,449,916 B1 * 9/2002 Waters ..... 52/455
6,526,707 B2 3/2003 Tucker
6,553,735 B1 * 4/2003 Wang Chen ..... 52/455
6,619,005 B1 * 9/2003 Chen ..... 52/455
6,691,483 B2 * 2/2004 Lethers ..... 52/455
6,729,095 B2 * 5/2004 Wang Chen ..... 52/456
6,931,810 B2 * 8/2005 Beaudoin et al. ..... 52/455
7,100,342 B2 * 9/2006 Holloway ..... 52/782.1
2005/0046318 A1 * 3/2005 Geller ..... 312/348.4
2006/0001338 A1 * 1/2006 Geller ..... 312/348.4

* cited by examiner

*Primary Examiner*—Richard E Chilcot, Jr.
*Assistant Examiner*—Alp Akbasli

(57) ABSTRACT

A repairable drawer or door assembly has a rear panel and a front panel that each have corresponding openings. Perimeter portions around the openings in the two panels are formed to capture a window. A removable escutcheon plate covers raw edges of the perimeter around the insert opening. The rear panel is fastened to the front panel to create an assembly that has no visible means of fastening on the exterior.

19 Claims, 4 Drawing Sheets

DRAWER OR DOOR FRONT ASSEMBLY WITH RECONFIGURABLE INSERTS PANEL

CROSS REFERENCE TO RELATED APPLICATION

This application is related to application publication number 2005/0046318A1 entitled "DRAWER OR DOOR FRONT ASSEMBLY", filed Apr. 26, 2004 and also to application Ser. No. 10/883,608, entitled "DRAWER OR DOOR FRONT ASSEMBLY WITH INTEGRAL PORT", filed Jul. 1, 2004, both of which are herein incorporated by reference.

FIELD OF THE INVENTION

This invention relates generally to interlocking panel assemblies, and more particularly to cabinet drawer fronts or door fronts that have an insert panel such as glass or other decorative materials that can be reconfigured or repaired.

BACKGROUND

Drawer and door fronts for cabinets, such as kitchen, bathroom or other storage units have traditionally been manufactured from wood, man-made wood products, metal, and/or plastic. Typically, these fronts are made from multiple pieces, fastened together using mechanical fasteners such as nails, screws, bolts, welds, adhesives, etc. This not only complicates the design of the door or drawer fronts, but adds to the material cost and the labor cost. In situations where metal is used to fabricate the door or drawer fronts, two panels, a front and a rear, are traditionally fastened together to create an assembly by spot-welding or using screw-type fasteners. The problem with each of these fastening methods is that, in addition to high labor costs, they leave obvious and unsightly evidence of their presence on the exterior of the door or drawer front, and that is unacceptable in many markets.

Additionally, when sheet metal is formed to create the panels of the door or drawer front, the juncture at the corners where the vertical walls of the panels meet leaves a gap that is also unsightly and undesirable. Some have chosen to arc or gas weld this joint, and then grind down the weld to attempt to create a visually pleasing joint, but even with the finest craftsmanship, the ground weld leaves evil notice of its presence. This problem manifests itself not only on the outside corners of the panel, but also on inside corners when one desires to incorporate an opening in the panel, or to provide an insert such as a decorative panel or a glass window. Like the exterior corners, the edges and corners of these inside corners of the opening need to be treated to alter any rough edges for both safety and aesthetics. The usual method is to carefully smooth and polish the cut edges, but this also requires extra assembly steps, each increasing the end product cost, and the appearance is still not of the highest quality, obviating the creation of an opening with a clean, modern appearance. Additionally, the prior art that welded the front and rear panels together sandwiched the insert panel permanently between the front and rear panels, and if the glass window were to be damaged or broken, it could not be repaired without destroying the entire assembly. It would be a valuable addition to the art if a method to create an opening in a metal drawer or door front could be designed that would obviate the need for these extra labor steps, would have smooth and uniform edges to create an aesthetically pleasing and cost effective assembly, and could be easily repaired or modified without destroying the entire assembly.

BRIEF DESCRIPTION OF THE DRAWINGS

The features of the invention, both as to organization and method of operation, together with objects and advantages thereof, may be best understood by reference to the following detailed description, which describes certain exemplary embodiments of the invention, taken in conjunction with the accompanying drawings in which.

DETAILED DESCRIPTION

Figure 1:
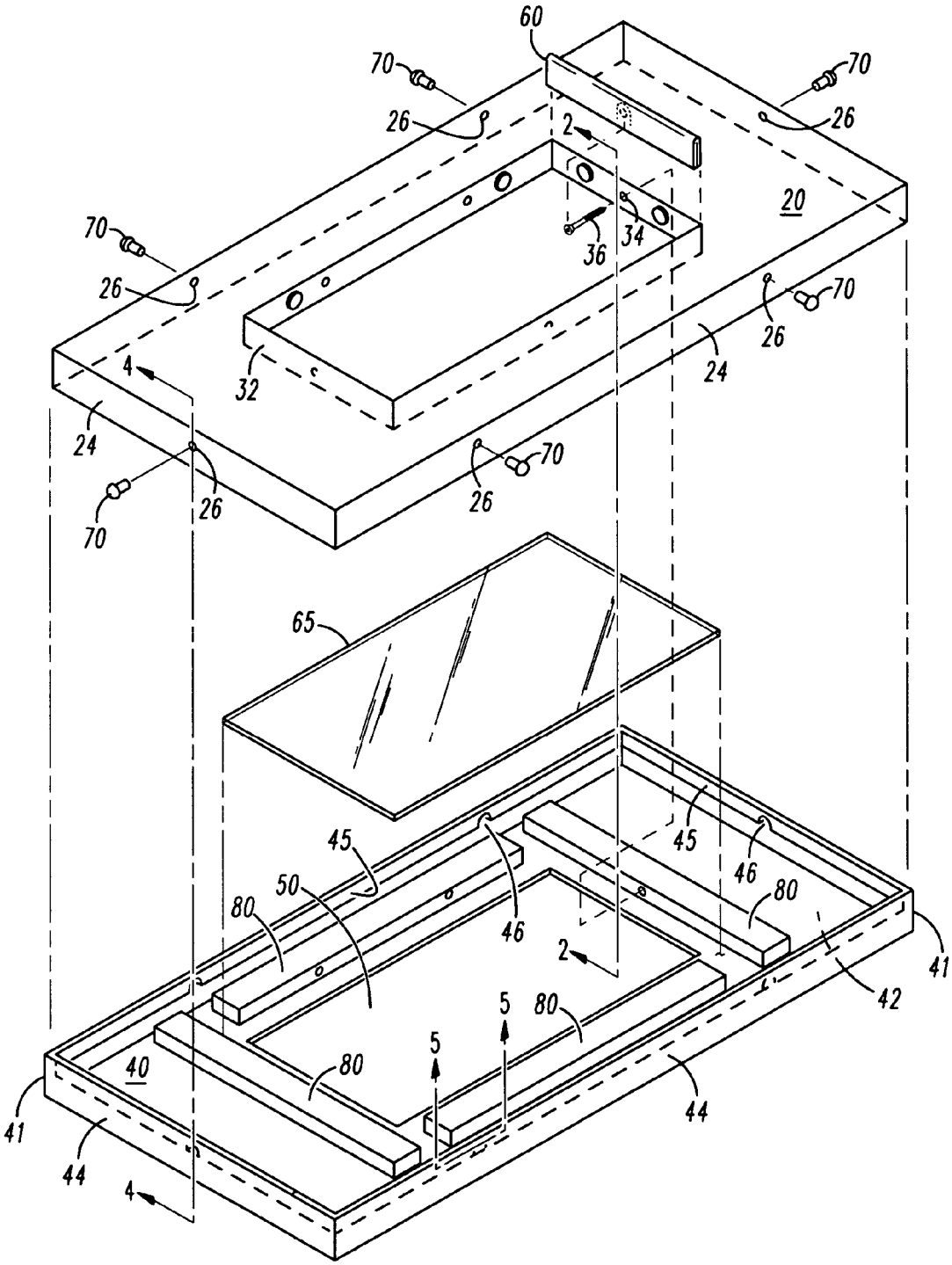
FIG. 1 is an exploded perspective view consistent with certain embodiments of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding elements in the several views of the drawings. Referring now to FIG. 1, an exploded perspective view, and FIG. 2, a cross sectional view of one embodiment of the invention, a door front assembly 10 or similar item consists of an outer or front panel 40 and an inner or rear panel 20. Although a door front assembly is used as an example to describe the invention, other types of assemblies can also utilize this technique, such as drawers, sliding doors, panels, shelves, etc, and still fall within the scope and spirit of the invention. Both the outer and inner panels 40, 20 may be made of sheet metal, for example steel, stainless steel, aluminum, brass, or copper, and may be formed to create a five-sided rectangular box, although other shapes are envisioned, such as circles, ellipses and polygons, with one side open to form a cavity.

The rear panel 20 has an opening or port 30 formed therein. Although depicted in the drawing as a rectangle, the opening 30 can be any shape, such as square, rectangular, round, elliptical, polygonal, etc, depending on the desire and whim of the designer, and can be located anywhere within the major face or major plane 22 of the panel. Surrounding the opening 30 is a perimeter wall 32 that is formed to at least partially frame the opening. This may be accomplished by inwardly (i.e. downwards, as depicted in the drawing) bending one or more portions of the major plane that are at the periphery of the opening 30 so that the portions are perpendicular to the major plane to form the wall 32. Apertures 34 are located at various points in the perpendicularly formed portions (the wall) 32 to receive a fastening means 36 such as a screw, rivet, nail, bolt, etc.

Figure 2:
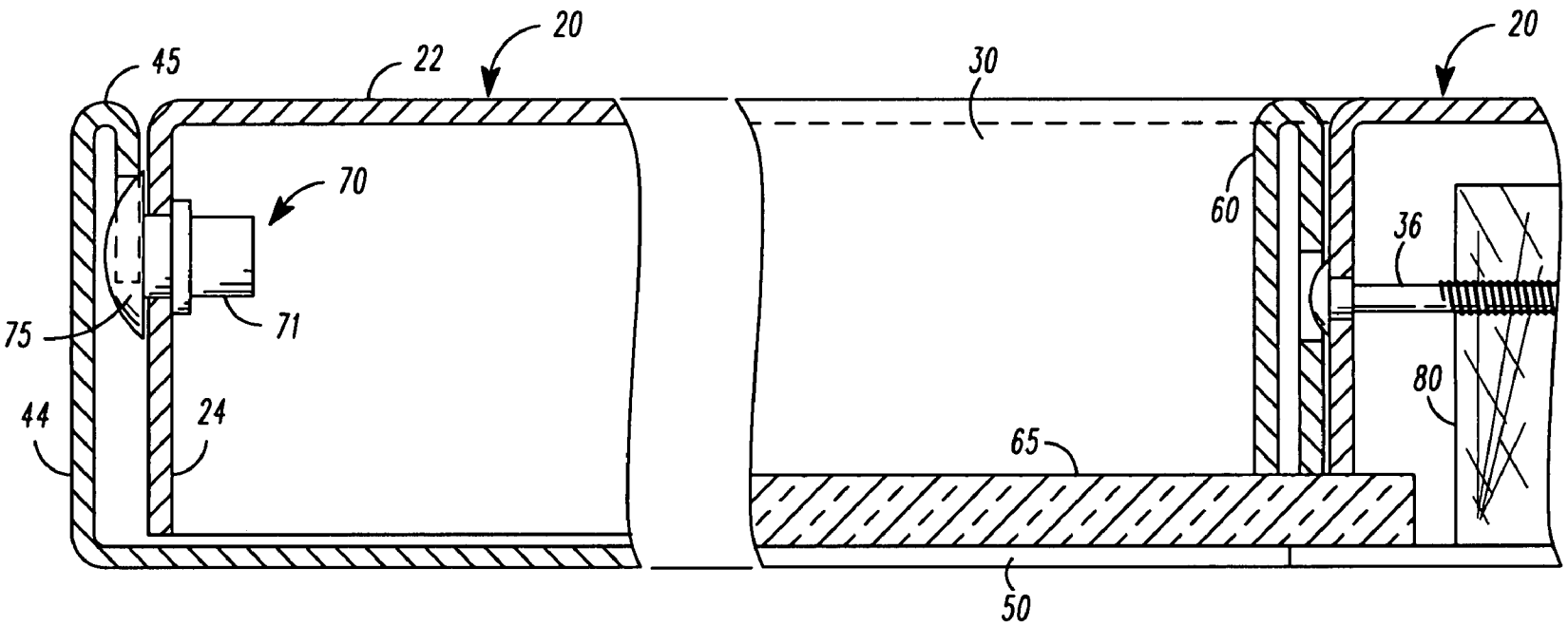
FIG. 2 is a cross-sectional view of a portion of FIG. 1, consistent with certain embodiments of the present invention.
Figure 3:
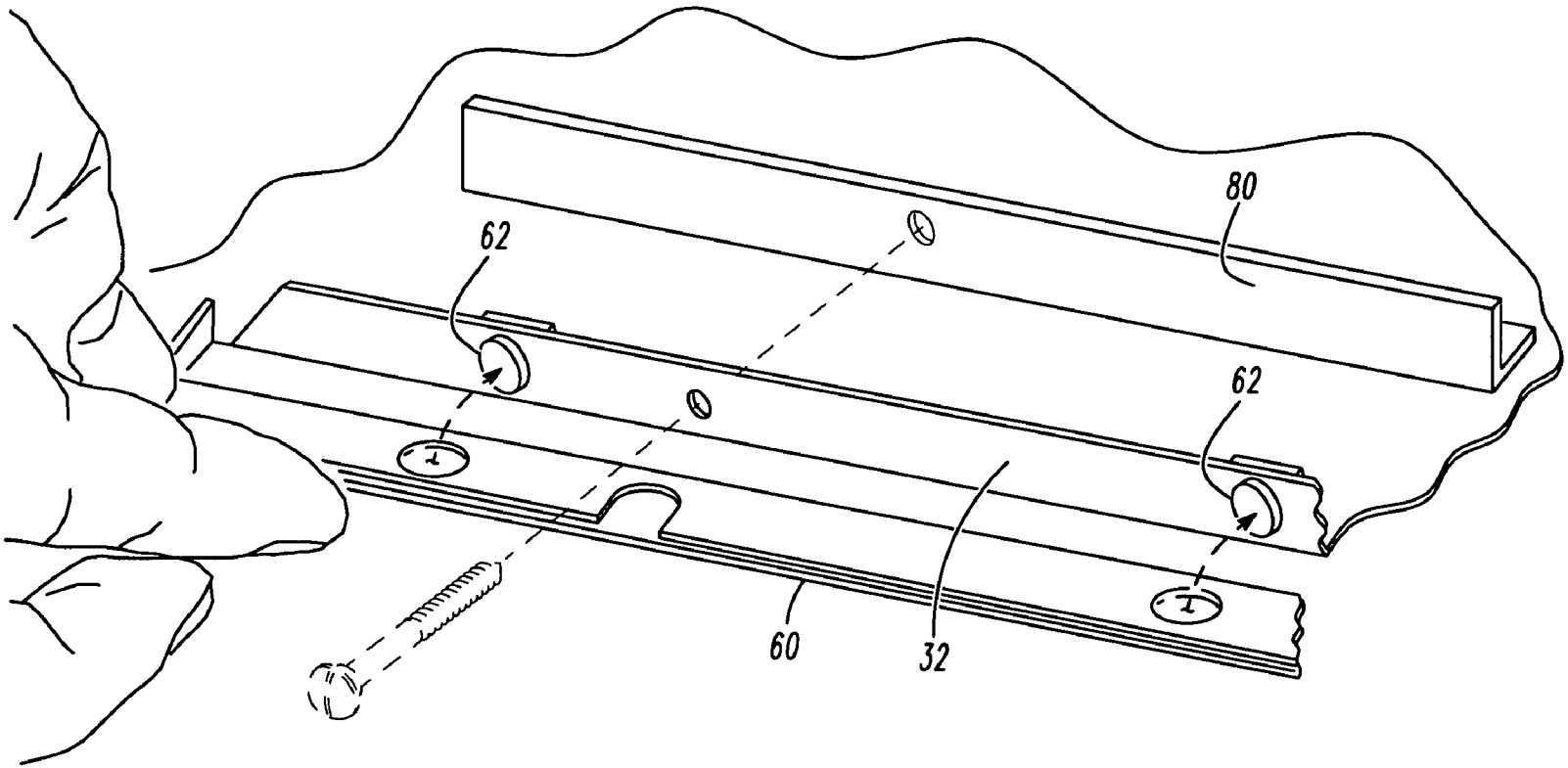
FIG. 3 is a perspective view of an escutcheon plate, consistent with certain embodiments of the present invention.

A front panel 40 likewise has an opening or port 50 created in the major plane 42 that corresponds to the opening 30 in the rear panel 20. Surrounding the opening 50 are securing means 80 that will serve as anchors to receive the fastening means 36. The securing means or anchors 80 can completely surround the opening 50, or can be intermittent, or can be located only in certain areas, as desired by the designer. The securing means also serves to rigidize the door assembly, and thus can also be referred to as a rigidizer or rigidizing means. The anchors 80 can take a number of forms, such as wood strips glued to the major plane 42 of the panel 40. Other materials can also be used, such as composition board (medium density fiberboard, particle board, flake board, etc.), man-made wood products (plywood, blends of wood and plastic, etc.), or plastics and metal formed in various cross-sectional shapes such as "C", "L" or "T. The securing means may be bonded to the major plane by means of an adhesive, such as epoxy, urethane, pressure sensitive adhesive, hot melt, etc., but can also be welded. An insert panel 65, such as a sheet of glass or other transparent, translucent, or opaque material, that is larger in area than the opening 50 is disposed in the opening by placing it on to the major plane 42 of the front panel as shown. If desired, the insert panel can be temporarily held in position by means of a weak adhesive or caulking. The various features of the assembly are appropriately dimensioned so that when assembled, the insert panel 65 is captured between the major plane 42 of the front panel and the edge of the perpendicularly formed portions 32 on the rear panel. The rear panel 20 is then joined to the front panel 40 in a suitable fashion in order to form the door or drawer assembly. A trim piece or escutcheon plate 60 serves to cover the fastening means 36 and is formed to fit inside the opening on the side of the wall 32 that faces the opening 30. FIGS. 2 and 3 shows the escutcheon plate 60 formed as a flattened 'U' but other shapes and configurations will serve and can be substituted as necessary. The escutcheon plate 60 is removably attached to the outside face of the wall 32 by using one or more small magnets 62, but can also be held in place by clips, adhesives, or other suitable means of fastening. The escutcheon plate 60 contains a cavity or recess in appropriate locations to receive the head of the fastening means 36, thereby effectively hiding the fastening means, so that no visible means of fastening is apparent on the exterior of the assembled door. The lack of visible fasteners provides a door or drawer assembly that appears sleek and modern and speaks of high quality.

When one desires to remove or replace the insert panel, such as might occur when the glass window breaks, or when one wishes to change the décor by substituting an insert panel of differing design, the escutcheon plates 60 are removed by prying them away from the perpendicularly formed walls 32 to "break" the magnetic or adhesive bond. The fastening means 36 are removed from the securing means 80, and the rear panel is removed from the front panel by deflecting the outer perimeter walls 44 away from the outer perimeter walls 24 so that the head of the deformable members 70 can pass by the partial apertures 46. So opened, the insert panel can now be removed and replaced with the new one, and the entire door re-assembled as described originally.

Although the rear panel 20 can be assembled to the front panel 40 in a number of ways such as welds, adhesives, snap fits, or mechanical fasteners, I find the following method of joining particularly suitable to form an aesthetically pleasing and cost effective door or drawer panel assembly. Referring now to FIG. 2, the two panels are dimensioned so that the inner or rear panel 20 nests inside of the cavity in the outer panel 40, with the open cavities of both the outer and inner panels facing each other. The inner panel 20 is formed to have a portion of each perimeter portion bent at a right angle to the major face 22 to form an outer perimeter wall 24 so that vertical edges of adjacent walls are in close proximity and form a seam at each corner. One or more holes or apertures 26 are formed at strategic locations on two or more of the walls 24 to subsequently receive the body 71 of a deformable member 70, such as a plastic rivet. The exact number and spacing of the apertures will, of course, vary with the dimensions of each unique drawer or door front, and a mechanical designer with ordinary skill in the art will understand that conventional design principles shall guide in the placement and number of the holes or apertures 26.

Figure 4:
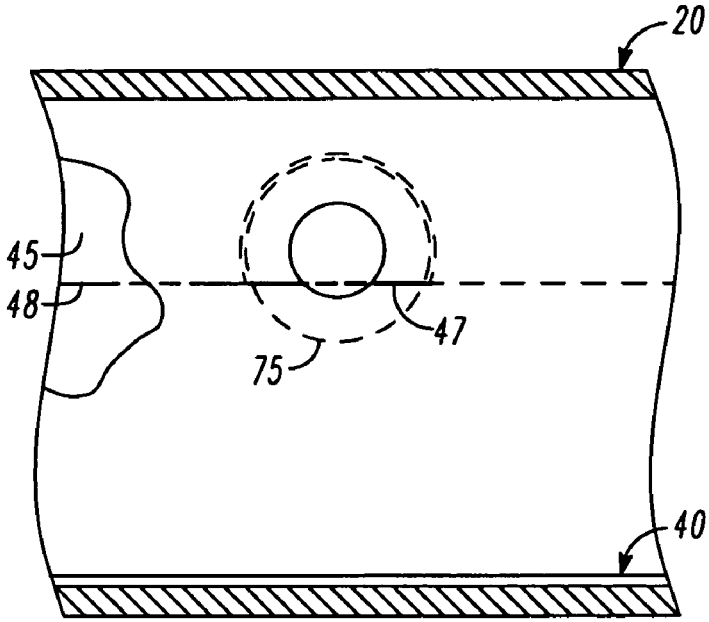
FIG. 4 is an elevational view of a portion of the assembly, viewed from the interior, consistent with certain embodiments of the present invention.
Figure 5:
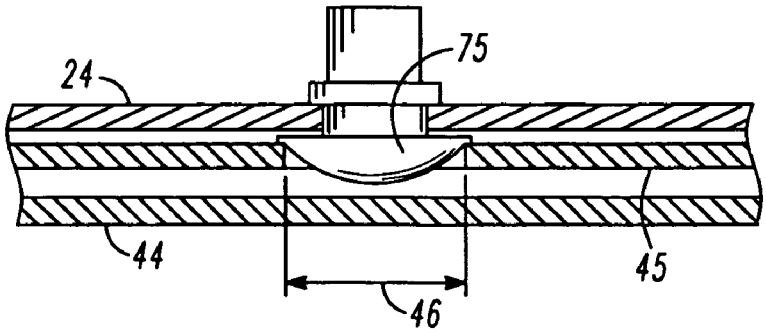
FIG. 5 is a cross-sectional view of FIG. 1, consistent with certain embodiments of the present invention.

The outer or front panel 40 is also formed so as to have a portion of each perimeter portion bent at a right angle to the major face 42 to form an outer perimeter wall 44. The walls 44 are formed such that the vertical edges of adjacent walls are in close proximity and form a seam 41 at each corner, similar to the inner panel 20. However, unlike the inner panel, each wall 44 has an additional formed portion 45 that is created by further bending an end portion 45 of the wall 180° to create a 'rolled edge' or hem that faces the cavity side. The dimensions of the outer panel 40 are arranged so that the inner panel 20 will fit precisely into the cavity of the outer panel with little 'play' or interference. Generally, the designer will wish to have the major face 22 of the inner panel coplanar to the top of the rolled edge of the outer panel, as shown in the drawing figures, but other embodiments that place the major face above or below the rolled edge are also envisioned. Partial apertures 46 that have one portion of the perimeter of the aperture open, are formed in the rolled edge 45 at locations that correspond to the locations of the holes 26 in the inner panel. Referring now to FIG. 4, a chord 47 of the aperture is in line with the end 48 of the rolled edge 45 to create a shape that can capture the head of the deformable member. The diameter of the aperture 46 is dimensioned to be slightly smaller than the major diameter of the head 75 of the deformable member 70 so as to create an interference fit between the head of the deformable member and the aperture, as shown in FIG. 5. A shaped aperture that is slightly larger than a semicircle is depicted in the drawings, but other shapes will occur to one skilled in the art, such as a semicircle, a square or rectangular aperture, a triangular aperture in the shape of an inverted 'V', or an aperture that is less than a semicircle.

One example of a deformable member 70 that I find suitable is a plastic snap rivet, but other deformable members such as plastic screws, rubber plugs, bumpers, or buttons can be substituted. Referring again to FIGS. 1 and 2, the plastic rivets are inserted and secured into each of the holes 26 so that the head 75 of the rivet is on the outside of the inner panel 20. The assembly 10 is put together by inserting the inner panel 20 into the outer panel 40 to form a closed box such that the cavity sides of each panel face each other, and the major faces 22, 42 are on the outside of the assembly. Since the head 75 of the deformable member 70 is slightly larger than the partial aperture 46, the inner panel needs to be forced into the outer panel. The head 75 of each rivet deforms as it passes by the smaller apertures 46, locking the inner and outer panels securely together. The head of the rivet also causes the formed wall 44, 45 to deflect outward as the two panels are fit together, until such point when the head of the rivet passes the smooth metal on the wall 45 and 'falls' into the aperture 46, whereupon the formed wall 44, 45 deflects back into the original position.

In order to create an assembly that is dimensionally accurate, pleasing to the eye and tight fitting, the various features of each of the panels 20, 40 are created by cutting with a laser, as opposed to stamping, drilling or other mechanical cutting procedures. In addition, the seam at the outside corners 41 of the outer panel 40, and optionally, some portions of the assembly such as the inside corners of the opening 30, 50, are preferably welded with a pulsed YAG laser. Laser welding produces a corner that needs little, if any, subsequent cleaning or polishing operations, and is mechanically solid, precise, and pleasing to the eye. Pulsed YAG lasers are preferred over $CO_2$ lasers because they can produce a smaller and cleaner weld without the heat buildup and subsequent puddling, voiding and distortion that occurs when using $CO_2$ lasers or conventional welding.

In summary, without intending to limit the scope of the invention, a drawer or door front assembly according to certain embodiments of the invention can be created with an replaceable window or insert panel. While the invention has been described in conjunction with specific embodiments, it is evident that many alternatives, modifications, permutations and variations will become apparent to those of ordinary skill in the art in light of the foregoing description.

What is claimed is:

1. A repairable door or drawer assembly having a window sandwiched between a first panel joined to a second panel, comprising:

a first panel having a major plane and having a port in the major plane for receiving the window;

securing means affixed to the major plane of the first panel between the perpendicular portion and the port;

a window, larger in area than the port, disposed in the port;

a second panel having a major plane and having a port in the major plane corresponding to the port in the first panel, a portion of the second panel major plane at a perimeter of the port formed perpendicular to the major plane to form a wall around the perimeter of the port;

fastening means penetrating through the perpendicular formed portion of the second panel and fastened to the securing means, such that the perpendicular formed portion of the second panel secures the window in the port of the front panel; and an escutcheon plate removably attached to the perpendicularly formed wall on a side of the wall that faces the port, for covering the fastening means such that no fasteners are visible on the exterior of the assembly.

2. The assembly as described in claim 1, wherein the first and second panels each further comprise four outer perimeter walls at right angles to the major plane;

wherein a deformable member is disposed in two or more outer perimeter walls of the first panel; and wherein the first panel is assembled to and retained within the second panel by means of the deformable member being captured in an aperture in the outer perimeter wall of the second panel.

3. The assembly as described in claim 2, wherein the deformable member has a head portion that is larger than a body portion, the body portion disposed in the first panel outer perimeter wall and the head portion on an exterior face of the wall.

4. The assembly as described in claim 2, wherein the deformable member comprises a plastic rivet, a plastic screw, a rubber plug, a bumper, or a button.

5. The assembly as described in claim 2, wherein the deformable member distorts and changes shape to at least partially conform to the shape of the capturing aperture when the first panel is assembled to the second panel.

6. The assembly as described in claim 1, wherein the fastening means comprises a screw.

7. The assembly as described in claim 1, wherein the escutcheon plate is removably attached to the second panel perpendicularly formed wall by means of a magnet or by adhesive bonding.

8. The assembly as described in claim 1, wherein the securing means comprises a strip made of wood, composition board, man-made wood products, metal, or plastic.

9. A reconfigurable door or drawer assembly having an insert panel therein, comprising:

a front sheet metal panel having a major plane and an outer perimeter wall, portions of the outer perimeter wall having a laser welded seam and having one or more recesses therein, and having a port in the major plane for receiving the insert panel;

rigidizing means affixed to the major plane of the front sheet metal panel about a perimeter of the port;

a rear sheet metal panel having a major face and an outer perimeter wall and arranged to fit within the front panel, and having a port in the major face corresponding to the port in the front panel, a portion of the rear panel major face at a perimeter of the port formed perpendicular to the major face to form a wall around the perimeter of the port;

an insert panel, larger in area than the port, disposed in the port;

deformable means for fastening, situated on an exterior side of the rear panel outer perimeter wall;

second fastening means penetrating through one or more portions of the perpendicular formed portions around the perimeter of the port of the rear panel and fastened to the rigidizing means, such that the perpendicular formed portions of the rear panel retains the insert panel in the port of the front panel;

the rear panel inserted into the front panel such that the rear panel outer perimeter wall is situated within the front panel outer perimeter wall, and the deformable means for fastening distorts and is captured by the one or more recesses to tightly retain the panels together; and an escutcheon plate removably attached to the perpendicular formed portions around the perimeter of the port of the rear panel on a side that faces the port, for covering the second fastening means such that no fasteners are visible on the exterior of the assembled assembly.

10. The assembly as described in claim 9, wherein the deformable means for fastening has a head portion that is larger than a body portion, the body portion disposed in the front panel outer perimeter wall and the head portion on an exterior face of the wall.

11. The assembly as described in claim 10, wherein the deformable means for fastening distorts and changes shape to at least partially conform to the shape of the capturing aperture when the rear panel is assembled to the front panel.

12. The assembly as described in claim 9, wherein the deformable means for fastening comprises a plastic rivet, a plastic screw, a rubber plug, a bumper or a button.

13. The assembly as described in claim 9, wherein corner joints of the four outer perimeter walls of the front panel are pulsed YAG laser welded.

14. The assembly as described in claim 9, wherein the second fastening means comprises a screw.

15. The assembly as described in claim 9, wherein the escutcheon plate is removably attached to the perpendicularly formed wall by means of a magnet or by adhesive bonding.

16. The assembly as described in claim 9, wherein the securing means comprises a strip made of wood, composition board, man-made wood products, metal, or plastic.

17. The assembly as described in claim 9, wherein the insert panel comprises a glass window.

18. A repairable door or drawer assembly having a window sandwiched between a first panel joined to a second panel, comprising:

a first panel having a major plane and having a port in the major plane for receiving the window;

anchors affixed to the major plane of the first panel between the perpendicular portion and the port;

a window, larger in area than the port, disposed in the port;

a second panel having a major plane and having a port in the major plane corresponding to the port in the first panel, a portion of the second panel major plane at a perimeter of the port formed perpendicular to the major plane to form a wall around the perimeter of the port;

fasteners penetrating through the perpendicular formed portion of the second panel and fastened to the anchors, such that the perpendicular formed portion of the second panel secures the window in the port of the front panel; and an escutcheon plate removably attached to the perpendicularly formed wall on a side of the wall that faces the port, for covering the fasteners such that no fasteners are visible on the exterior of the assembly.

19. The assembly as described in claim 18, wherein the first and second panels each further comprise four outer perimeter walls at right angles to the major plane;

wherein a deformable member is disposed in two or more outer perimeter walls of the first panel; and wherein the first panel is assembled to and retained within the second panel by the deformable member being captured in an aperture in the outer perimeter wall of the second panel.

* * * * *